US007735161B2

(12) United States Patent
Purington

(10) Patent No.: US 7,735,161 B2
(45) Date of Patent: Jun. 15, 2010

(54) CHEST PROTECTOR

(76) Inventor: Carolyn Purington, 38 Crawford Rd., Rutland, MA (US) 01543

( * ) Notice: Subject to any disclaimer, the term of this patent is extended or adjusted under 35 U.S.C. 154(b) by 188 days.

(21) Appl. No.: 11/305,057

(22) Filed: Dec. 16, 2005

(65) Prior Publication Data

US 2007/0136935 A1 Jun. 21, 2007

(51) Int. Cl.
*A41D 13/00* (2006.01)

(52) U.S. Cl. ..... 2/463

(58) Field of Classification Search ..... 2/463, 2/465, 467, 455, 94, 2.5
See application file for complete search history.

(56) References Cited

U.S. PATENT DOCUMENTS

| | | | | |
|---|---|---|---|---|
| 4,422,183 | A * | 12/1983 | Landi et al. | 2/455 |
| 5,742,947 | A | 4/1998 | Davis | |
| 6,219,852 | B1 * | 4/2001 | Bain et al. | 2/456 |
| 6,357,054 | B1 * | 3/2002 | Bainbridge et al. | 2/455 |
| 6,748,601 | B2 * | 6/2004 | LaShoto et al. | 2/102 |
| 2003/0167560 | A1 | 9/2003 | LaShoto et al. | |

OTHER PUBLICATIONS

Batter's & Fielder's Protection product information [online], [retrieved on Nov. 21, 2005]. Retrieved from the Internet: <URL: http://www.all-starsports.com/PDFs/all-star_bat-field.pdf>.
Heart-Gard Chest Protection SystemCF product information [online], [retrieved on Nov. 21, 2005]. Retrieved from the Internet: <URL: http://www.onlinesports.com/pages/1,MW-SMHG.html>.

* cited by examiner

*Primary Examiner*—Tejash Patel
(74) *Attorney, Agent, or Firm*—Fish & Richardson P.C.

(57) ABSTRACT

A chest protector to reduce risk of commotio cordis. The chest protector includes an inner protector member and an outer shell. The inner protector member includes a protector plate and one or more supporting members. The protector plate has a first surface facing the user's chest and a second surface facing away from the user's chest, and the first surface has a central portion and side portions. The one or more supporting members are attached to the side portions of the first surface of the protector plate but not to the central portion of the first surface such that an air space is defined by the central portion of the first surface and the one or more supporting members. The protector plate and the one or more supporting members are configured such that the central portion of the first surface of the protector plate is spaced apart from the chest. When an object impacts the second surface of the protector plate, the impact force is distributed to the supporting members and passed to side portions of the user's chest.

41 Claims, 9 Drawing Sheets

F1

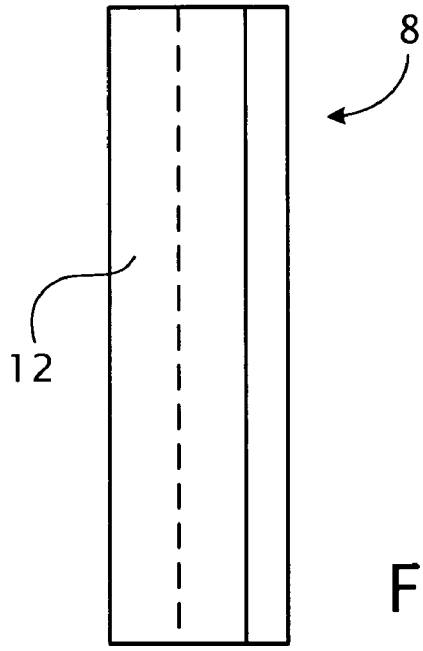
FIG. 3C
FIG. 3D
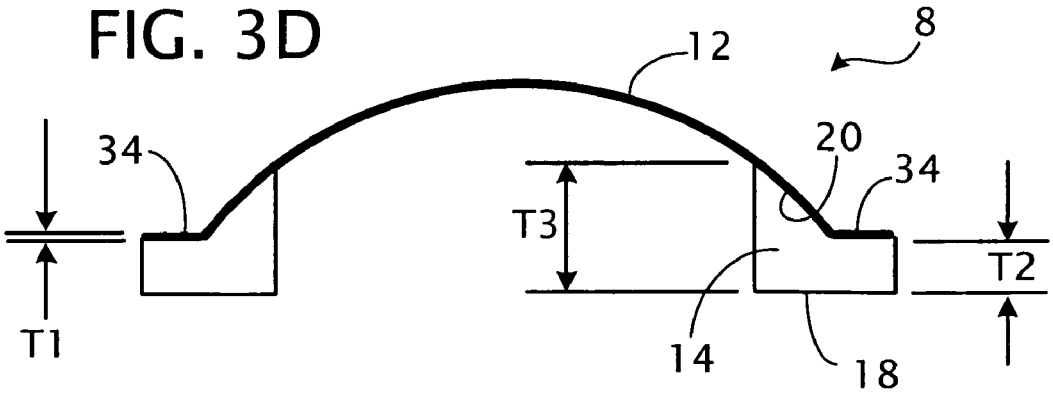
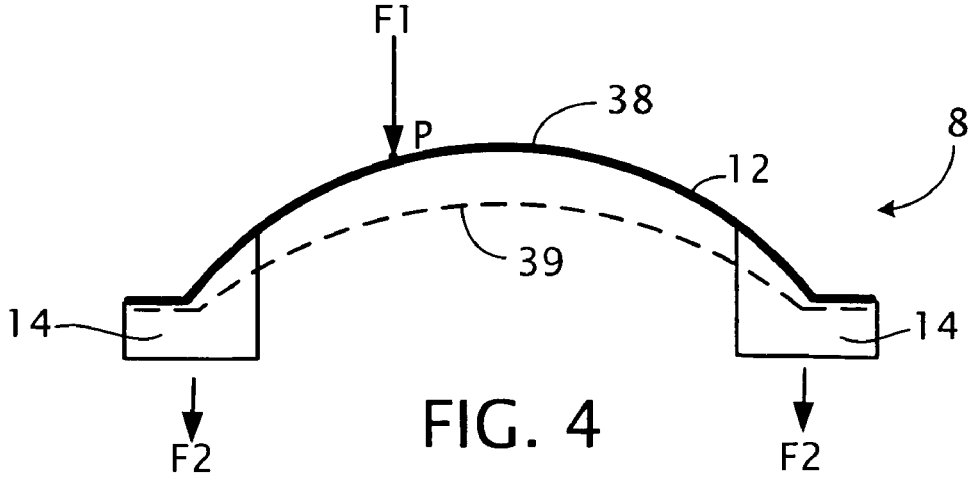
FIG. 4

CHEST PROTECTOR

BACKGROUND

This description relates to chest protectors.

Commotio cordis is a syndrome in which a blunt impact to the chest causes life threatening ventricular fibrillation (an irregularity in the rhythm and force of the heartbeat), which may lead to sudden death without structural damage to the heart. Commotio cordis most commonly occurs in sports such as baseball, lacrosse, softball, and hockey, when a ball or puck impacts the front, midline chest in the area superficial to the left ventricle of the heart at about 40 mph (17.88 m/s). In some cases, commotio cordis happens when the impact occurs at 20 milliseconds before the T wave portion of a heartbeat, when the heart is undergoing repolarization, or restoring its energy to pump again. The impact causes the heart to enter a ventricular fibrillation rhythm that causes ineffective pumping, and in some cases, sudden death Since 1998, there have been 156 deaths in the United States attributed to commotio cordis. See Link, Mark S., "Mechanically induced sudden death in chest wall impact (commotio cordis)," Progress in Biophysics and Molecular biology, 82 (2003), pages 175-186. According to a study at Tufts University in 2003, led by Barry Maron, who researched 128 confirmed cases of commotio cordis that were entered into the United States Commotio Cordis Registry, the overall survival rate of commotio cordis was about 16%. Of the 128 cases, 95% were males. The mean age of the commotio cordis victims was 13.6 years, and only about 22% of the victims were greater than 18 years old.

A number of chest protectors have been developed in the past. For example, U.S. Pat. No. 5,742,947 describes an adjustable chest protector that is designed to cover the heart area of a human body, and U.S. Pat. No. 6,748,601 describes an articulating body protective device that includes a fabric outer garment and protective elements.

SUMMARY

In a general aspect, a chest protector to reduce risk of commotio cordis by providing a protector shield to reduce the impact force to the anterior central chest superficial to the left ventricle. The chest protector dissipates the impact of objects and redistributes the resultant force to lower risk areas of the chest. The chest protector can be made light-weight so that it does not hinder the wearer's movements, and can be made at a low cost.

In one aspect, in general, a chest protector for reducing risk of commotio cordis, the chest protector including an inner protector member and an outer shell to enclose the inner protector member. The inner protector member includes a protector plate having a first surface facing the user's chest and a second surface facing away from the user's chest, the first surface having a central portion and side portions, and one or more supporting members attached to the side portions of the first surface of the protector plate but not to the central portion of the first surface such that an air space is defined by the central portion of the first surface and the one or more supporting members. The protector plate and the one or more supporting members are configured such that the central portion of the first surface of the protector plate is spaced apart from the chest, and when an object impacts the second surface of the protector plate, the impact force is distributed to the supporting members and passed to side portions of the user's chest.

Implementations of the chest protector may include one or more of the following features. The chest protector includes straps for holding the outer shell at a location such that the protector plate is positioned in front of the user's chest. The straps and outer shell are configured to position the one or more supporting members away from an area of the chest superficial to the left ventricle of the heart. The protector plate and the one or more supporting members have dimensions and materials such that, when an object having a mass of about 155 grams traveling at about 40 mph impacts the second surface of the protector plate, the impact force passed to the side portions of the user's chest is less than about 70% of the impact force imparted by the object to the second surface of the protector plate. In some examples, the protector plate and the one or more supporting members have dimensions and materials such that, when an object having a mass of about 155 grams traveling at about 40 mph impacts second surface of the protector plate, the central portion of the protector plate presses against the user's chest at a force that is less than the force that would have imparted to the user's chest if the one or more supporting members were not used. In some examples, the protector plate and the one or more supporting members have dimensions and materials such that, when an object having a mass of about 155 grams traveling at about 40 mph impacts second surface of the protector plate, the central portion of the protector plate resists pressing against the user's chest. In some examples, the protector plate has a flat surface. In some examples, the protector plate has a convex surface relative to the chest. The protector plate includes polycarbonate resin. The one or more supporting members include shock absorbing material. The one or more supporting members include two vertical ribs. The one or more supporting members include blown polyethylene. The protector plate has a width between about 15 cm to about 30 cm. Each of the one or more supporting members has a depth between about 2 cm and about 6 cm. The outer shell includes a mesh.

In another aspect, in general, a chest protector for a user's chest, including a polycarbonate plate, shock absorbing members, an outer shell, and straps. The shock absorbing members are attached to a surface of the polycarbonate plate, in which the shock absorbing members are spaced apart and positioned away from a central portion of the surface of the polycarbonate plate. The outer shell encloses the polycarbonate plate and the shock absorbing members, in which the central portion of the surface of the polycarbonate plate, the shock absorbing members, and an inner surface of the outer shell defines an air space. The straps holds the chest protector in front of the user's chest such that the air space is between the central portion of the surface of the polycarbonate plate and the user's chest.

Implementations of the chest protector may include one or more of the following features. The shock absorbing members include two vertical ribs. The shock absorbing members include blown polyethylene. In some examples, the polycarbonate plate is flat. In some examples, the polycarbonate plate has a convex shape relative to the chest.

In another aspect, in general, a chest protector for a user's chest, the chest protector including a protection means to absorb a portion of an impact force and distribute remaining impact force to side portions of the user's chest away from an area of the chest superficial to the left ventricle of the heart, and a positioning means to position the protection means in front of the user's chest.

In another aspect, in general, a method of reducing risk of commotio cordis, including positioning a protector plate in front of a user's chest, providing one or more shock absorbing members between the protector plate and side portions of the user's chest, forming an air space between the protector plate and a central portion of the user's chest, and distributing an impact force towards side portions of the user's chest and away from an area of the chest superficial to the left ventricle of the heart.

Implementations of the chest protector may include the following feature. The method further includes enclosing the protector plate and the one or more shock absorbing members in an outer shell.

An advantage of the chest protector is that it can distribute the impact force from an object traveling toward a user's front chest away from areas superficial to the left ventricle of the heart. This is an improvement over many currently commercially available chest protectors that evenly distribute the impact force to the chest but that do not protect the central chest.

DESCRIPTION OF DRAWINGS

FIGS. 3A, 3B, 3C, and 3D show a perspective view, a front view, a side view, and a bottom view of an inner protector component of a chest protector.

FIG. 4 shows a bottom view of the protector component of FIGS. 3A-3D.

DESCRIPTION

Figure 1:
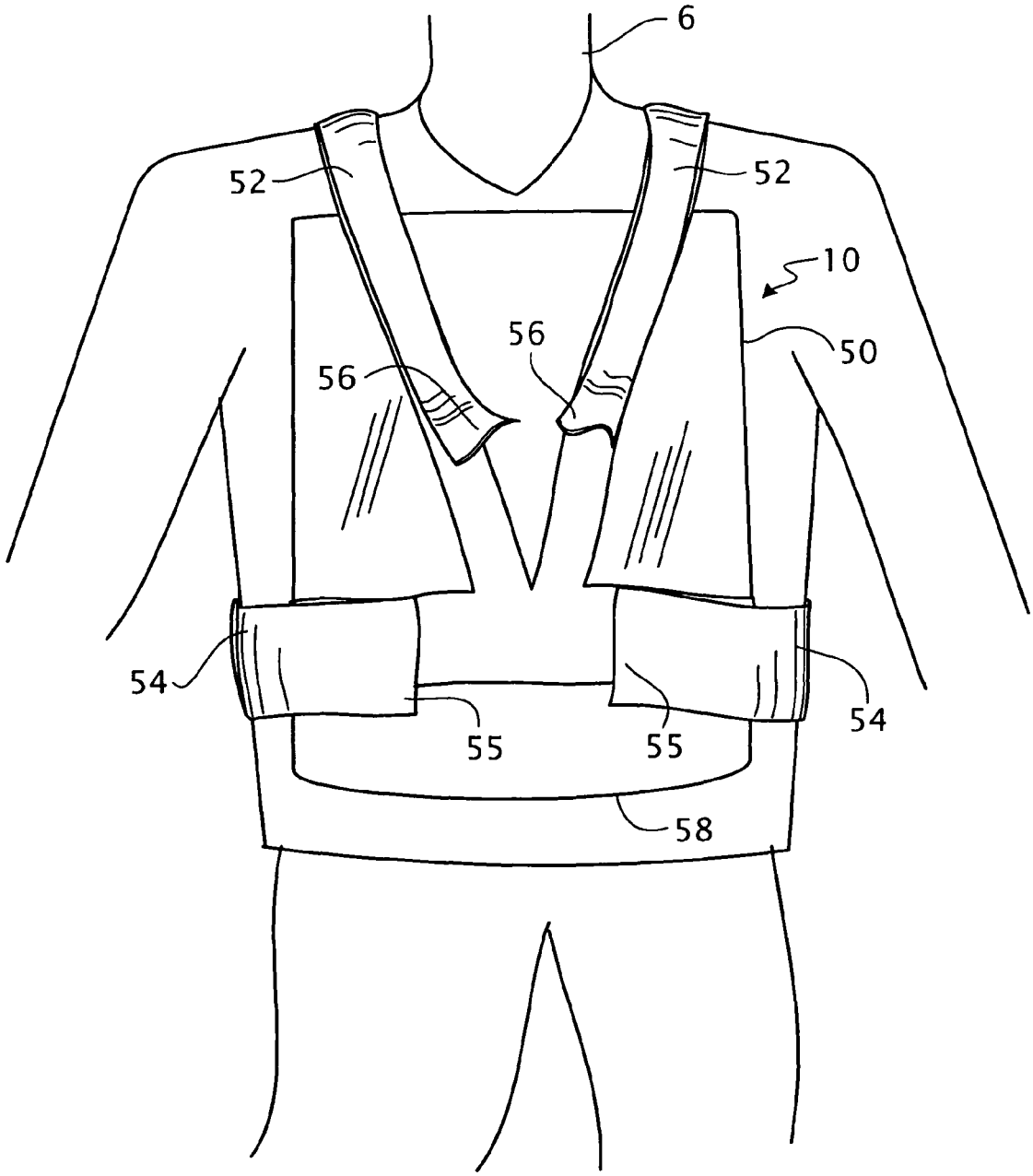
FIGS. 1 and 2 show a user wearing a chest protector.
Figure 2:
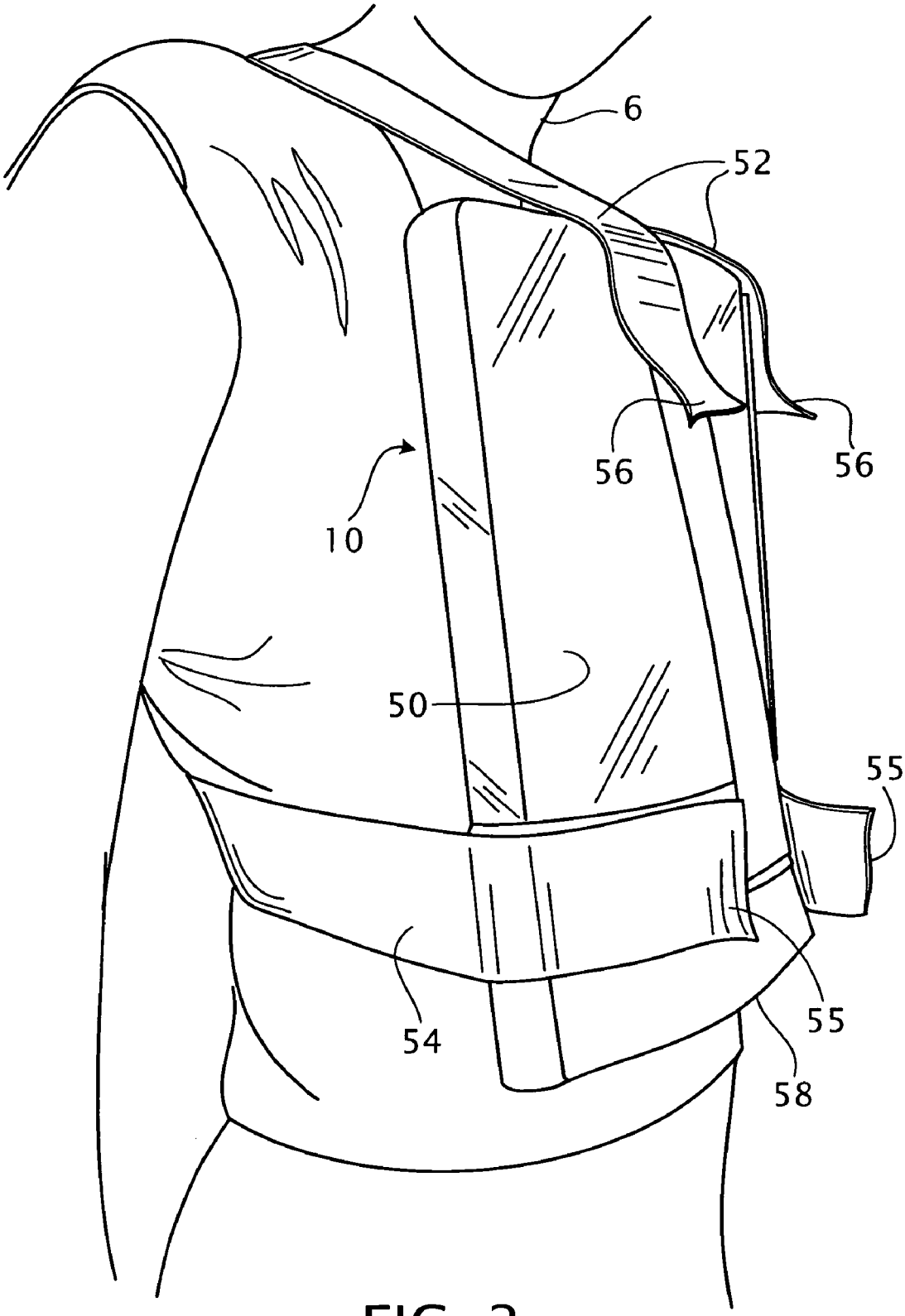

FIG. 1 shows a chest protector 10 that includes an outer shell 50 enclosing an inner protector module, and elastic straps 52 and 54 to hold the outer shell 50 and the inner protector module in front the chest of a user 6. FIG. 2 shows a side view of the user 6 wearing the chest protector 10. The chest protector 10 can prevent a flying object, such as a baseball, from directly hitting the anterior central chest in an area superficial to the left ventricle of the heart. As will be described in more detail later, the inner protector module includes a protector plate and support ribs. When the flying object hits the protector plate, the impact force is distributed to the support ribs, which distribute the impact force to portions of the chest away from the area superficial to the left ventricle of the heart, thereby reducing risk of commotio cordis.

The outer shell 50 can be made of, for example, nylon. The elastic straps 52 go around the back and over the shoulders, and have cooperating hook-and-loop-type fasteners 56 to allow adjustment for proper fit. The elastic straps 54 go around the waist and also have cooperating hook-and-loop-type fasteners 55 to allow adjustment for proper fit. The straps 52 and 54 are joined at the back of the user 6. The outer shell 50 has an opening 58 at the bottom to allow the inner protector module to be taken out. This is useful when replacing the inner protector module or when washing the outer shell 50. Cover flaps having cooperating hook-and-loop-type fasteners are used to close off the opening 58 when the inner protector module is inserted into the outer shell 50.

Figure 3A:
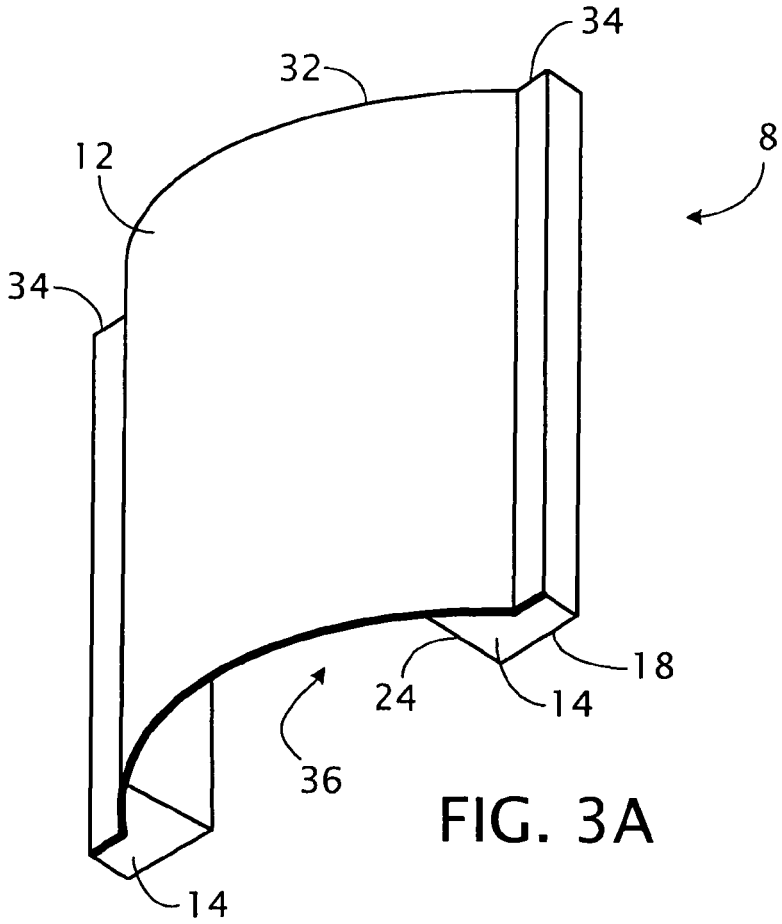
Figure 3B:
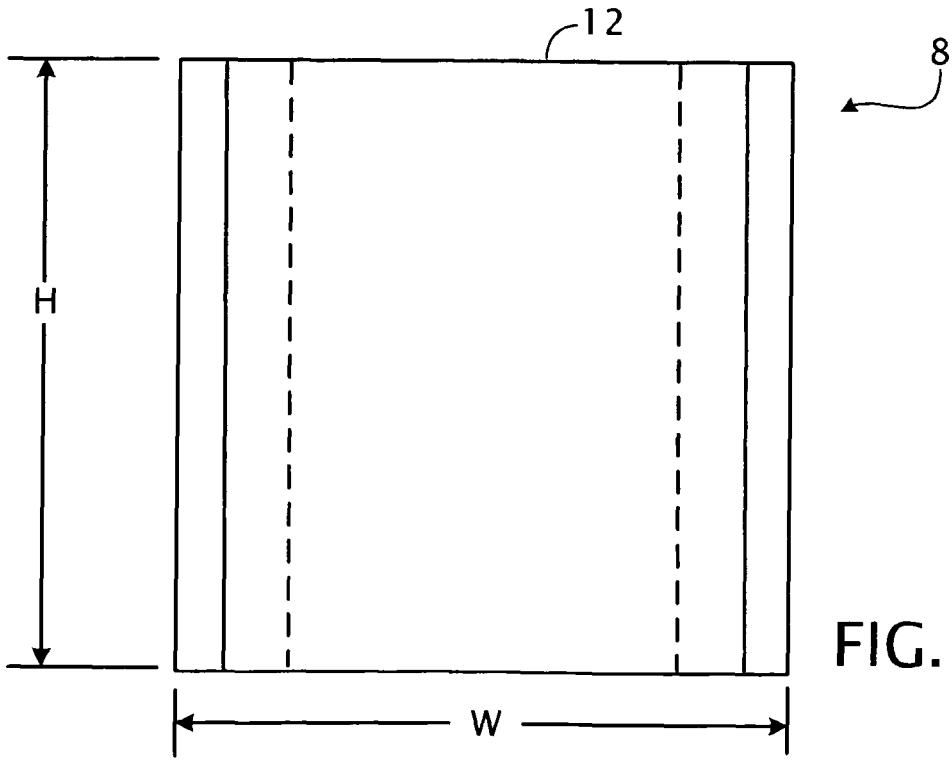
Figure 5A:
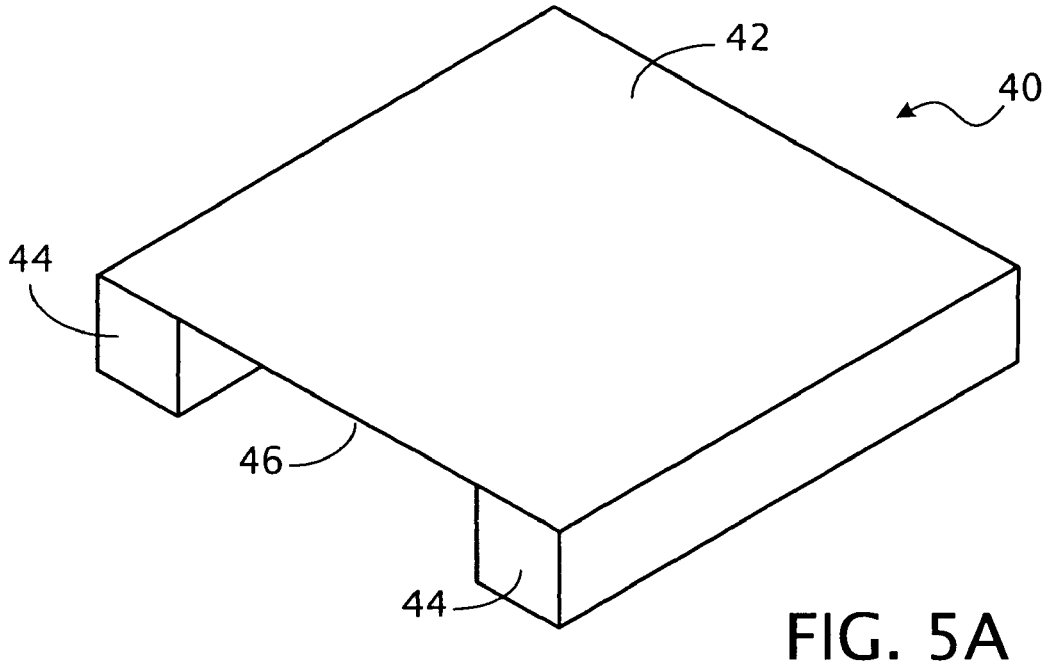
FIGS. 5A, 5B, 5C, and 5D show a perspective view, a front view, a side view, and a bottom view of another example of an inner protector component of a chest protector.
Figure 5B:
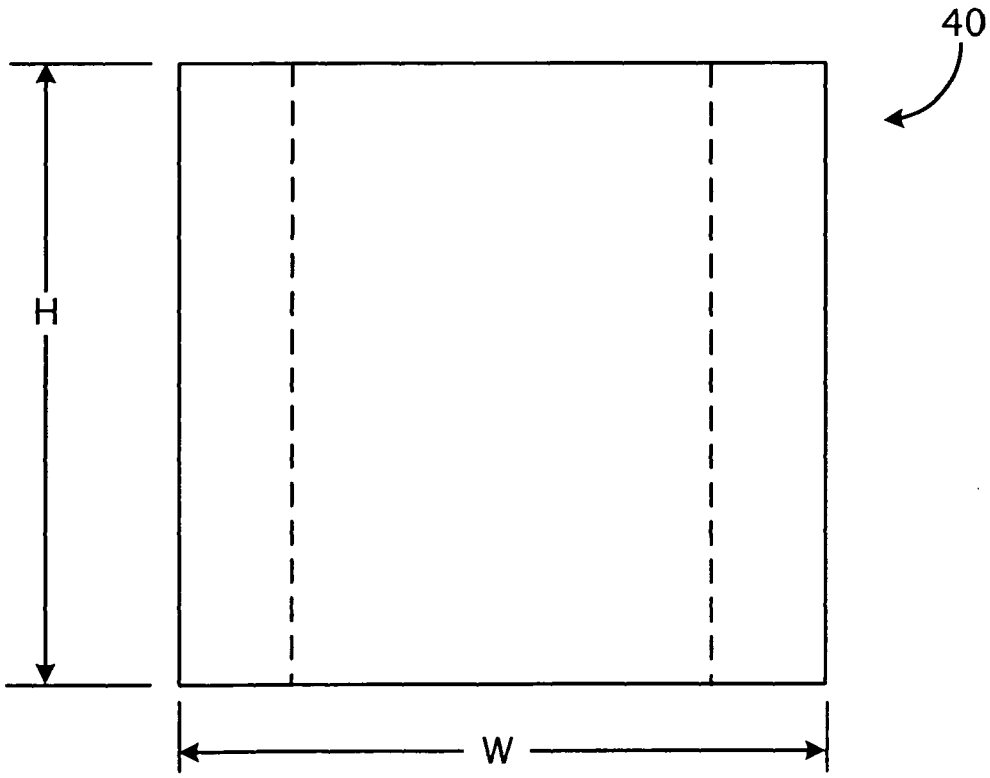
Figure 5C:
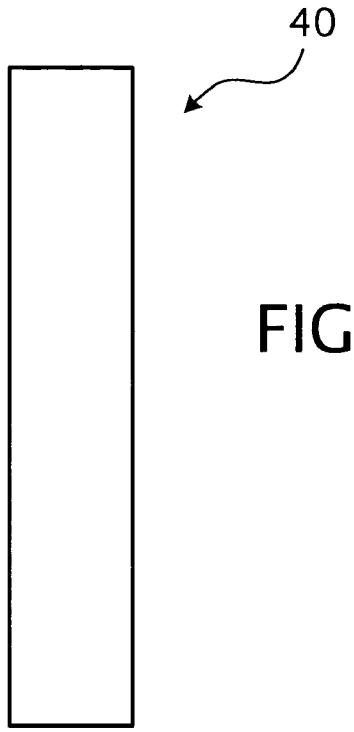
Figure 5D:
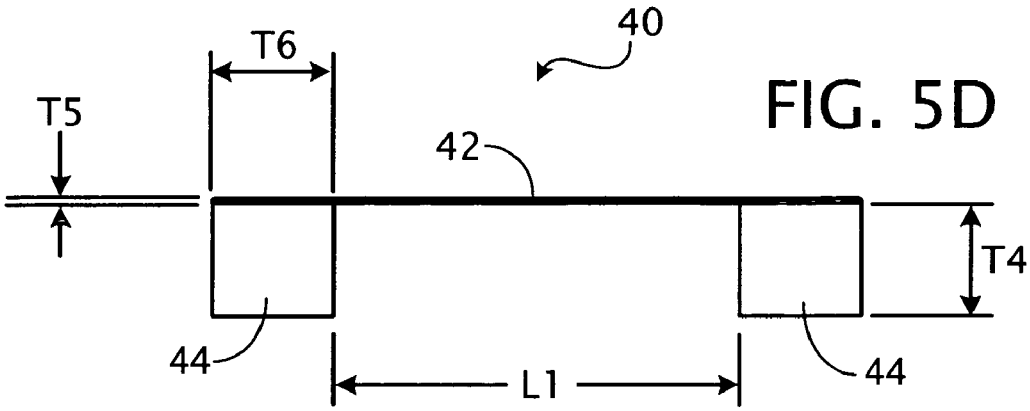

FIG. 3A shows a perspective view of an example of the inner protector module 8, which includes a protector plate 12 coupled to two support ribs 14. FIGS. 3B, 3C, and 3D show a front view, a side view, and a bottom view, respectively, of the protector module 8. The protector plate 12 includes a central portion 32 that has a generally convex shape that follows the contour of the front chest. The protector plate 12 includes two flat portions 34 at the sides to allow impact forces to be more evenly distributed to the support ribs 14.

In this example, the protector plate 12 can be made of polycarbonate resin, such as Lexan® polyphthalate carbonate resin, available from GE Plastics, Pittsfield, Mass. Lexan polyphthalate carbonate resin has a high tensile strength, and is suitable for use in temperatures ranging from −40° to 100° C. The protector plate 12 can have, for example, a width W of 28 cm, a height H of 28 cm (see FIG. 3B), and a thickness T1 (see FIG. 3D) of 0.0236 cm. Different sizes (width and height) of the protector plate 12 can be used for people of different heights and widths. The size of the protector plate is selected so as to re-distribute the impact force to a location away from the area of the chest superficial to the left ventricle of the heart. The thickness T1 of the protector plate 12 is selected so that it has sufficient stiffness and strength to sustain an impact of, for example, a baseball flying at about 40 mph. Other thicknesses and/or materials may be employed where projectiles of other weights or sizes, and traveling at other speeds, for example, faster, are anticipated. Upon impact of the flying object, the protector plate 12 may bend slightly inwards towards the chest, but should not deform so much so as to actually contact the chest. The protector plate 12 is designed to be sufficiently thin so that it is light weight and comfortable to wear. Even if the protector plate 12 bends inwards to contact the chest, the force at which the plate 12 presses against the chest is greatly reduced as compared to using the protector plate 12 without the support ribs 14.

The two support ribs 14 function as shock absorbing members and provide cushion between the protector plate 12 and the chest. In one example, the support ribs 14 are made of blown polyethylene (1.7 lbs/cubic foot, or 27.23 kg/cubic meter), which is pliable and can absorb a portion of the impact force. Each of the support ribs 14 has a length that can be about the same as the height H of the protector plate 12. The support rib 14 has one side 20 (see FIG. 3D) that is glued to the protector plate 12, and another side 18 that faces the user's chest. The side 18 can be generally flat so as to evenly distribute the impact force to side portions of the chest. The support rib 14 can have a thickness T2=2 cm near the side portion 34 of the protector plate 12.

When a person wears the chest protector 10, the protector plate 12 is positioned in front of the chest, and the support ribs 14 are positioned at side portions of the chest. A space 36 is created between the protector plate 12 and the two support ribs 14, such that the protector plate 12 is spaced apart from the chest. In some examples, as shown in FIGS. 3A-3D, the space 36 extends at least one-third of the first surface of the protector plate. Referring to FIG. 4, when a flying object hits the protector plate 12 at, for example, a position P, with a force F1, the protector plate 12 may deform temporarily (for example, from a shape 38 to a shape 39). The initial impact force F1 is distributed to the two support ribs 14, which each exerts force F2 to the side portions of the chest. Because the protector plate 12 and the support ribs 14 absorb a portion of the force, the total force 2×F2 will be smaller than the initial impact force F1. Moreover, because the support ribs 14 deflect the impact force away from the area of the chest superficial to the left ventricle of the heart, the chest protector 10 can reduce risk of commotio cordis.

Some prototypes of the chest protectors were tested, and measurements show that the chest protector 10 can reduce the impact force by 47%, where the impact force is imparted by a JUGS rubber practice ball traveling at about 40 mph.

FIGS. 5A, 5B, 5C, and 5D show a perspective view, a front view, a side view, and a bottom view, respectively, of another example of an inner protector module 40. Similar to the inner protector module 8 (FIG. 1), the inner protector module 40 includes a protector plate 42 and two support ribs 44. In this example, the protector plate 42 is flat, which is easier to fabricate than the curved protector plate 12 of FIGS. 3A-3D.

Similar to the protector plate 12, the protector plate 42 can be made of a polycarbonate resin, such as Lexan® polyphthalate carbonate resin, and can have a width W of 28 cm, a height H of 28 cm (FIG. 5B), and a thickness T5 (FIG. 5D) of 0.0263 cm. Different sizes (width and height) of the protector plate 42 can be used for people of different heights and widths. The size of the protector plate 42 is selected so as to re-distribute the impact force to a location away from the area of the chest superficial to the left ventricle of the heart.

Similar to the support ribs 14, the support ribs 44 function as shock absorbing members and provide cushion between the protector plate 42 and the chest. In one example, the support ribs 44 are made of blown polyethylene (1.7 lbs/cubic foot, or 27.23 kg/cubic meter), and each of the support ribs 44 has a length that is about the same as the height H of the protector plate 42. The support rib 44 has one side that is glued to the protector plate 42, and another side that faces the user's chest. The side of the support rib facing the user's chest can be generally flat so as to evenly distribute the impact force to side portions of the chest. Each of the support ribs 44 can have a dimension of, for example, 28 cm×5 cm×5 cm.

The thickness T5 of the protector plate 42 is selected so that it has sufficient stiffness and strength to sustain an impact of, for example, a baseball flying at about 40 mph. Other thicknesses and/or materials may be employed where projectiles of other weights or sizes, and traveling at other speeds, for example, faster, are anticipated. Upon impact of the flying object, the protector plate 42 may bend slightly inward towards the chest, but should not deform so much so as to actually contact the chest. The protector plate 42 is designed to be sufficiently thin so that it is light weight and comfortable to wear. Even if the protector plate 42 bends inwards to contact the chest, the force at which the plate 42 presses against the chest is greatly reduced as compared to using the protector plate 42 without the support ribs 44.

Figure 6:
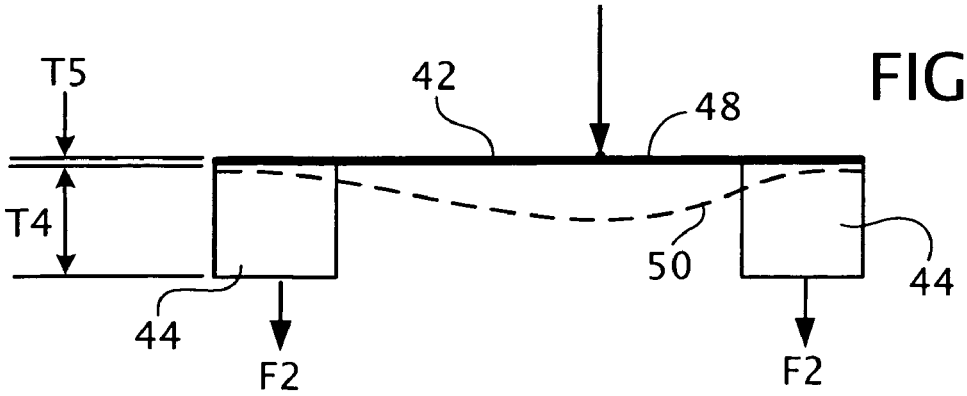
FIG. 6 shows a bottom view of the protector component of FIGS. 5A-5D.

Referring to FIG. 6, when a flying object hits the protector plate 42 with a force F1, the protector plate 12 temporarily deforms from a shape 48 to a shape 50. The impact force is distributed to the two support ribs 44, and transmitted to the side portions of the user's chest as forces F2. Because the protector plate 42 and the support ribs 44 absorb a portion of the force, the total force 2×F2 will be smaller than the initial impact force F1. By distributing the impact force to locations away from the area of the chest superficial to the left ventricle of the heart, the chest protector 42 can reduce risk of commotio cordis.

Experiments were conducted with prototype chest protectors 10 having inner protector modules 40, similar to the one shown in FIGS. 5A-5D. Each of the prototype chest protectors 10 has a flat Lexan protector plate 42 having a thickness of 0.0236 cm. Support ribs 44 made of blown polyethylene were attached to the protector plate 42. An ATEC (Athletic Training Equipment Company) pitching machine was used to pitch JUGS rubber practice balls at about 40 mph (17.88 m/s) toward each chest protector 40, which was strapped to a Vernier force plate. The Vernier force plate measures the total force imparted by a ball through the chest protector 10 onto the pate. This is similar to measuring the force sustained by the chest of a user hit by the ball when the user is wearing the chest protector 10. For comparison, the Vernier force plate also measured the force imparted by the ball without any chest protector.

The prototype chest protectors 10 were tested for an impact speed of about 40 mph because that is when the risk of commotio cordis is highest. JUGS rubber practice balls were used instead of regular baseballs to minimize the error. The stitches on regular baseballs change the speed and direction of the pitch, whereas JUGS balls have the same diameter and the same mass (155 grams) as regular baseballs.

Experiments show that, when the density of the blown polyethylene used for the support ribs 44 varied from 14.42 to 35.24 kg/m$^3$, the effectiveness of the chest protectors 10 to reduce impact forces were similar. Blown polyethylene having a density of 27.23 kg/m$^3$ was chosen as the material for the support ribs 44 of the chest protector in subsequent experiments.

Figure 7:
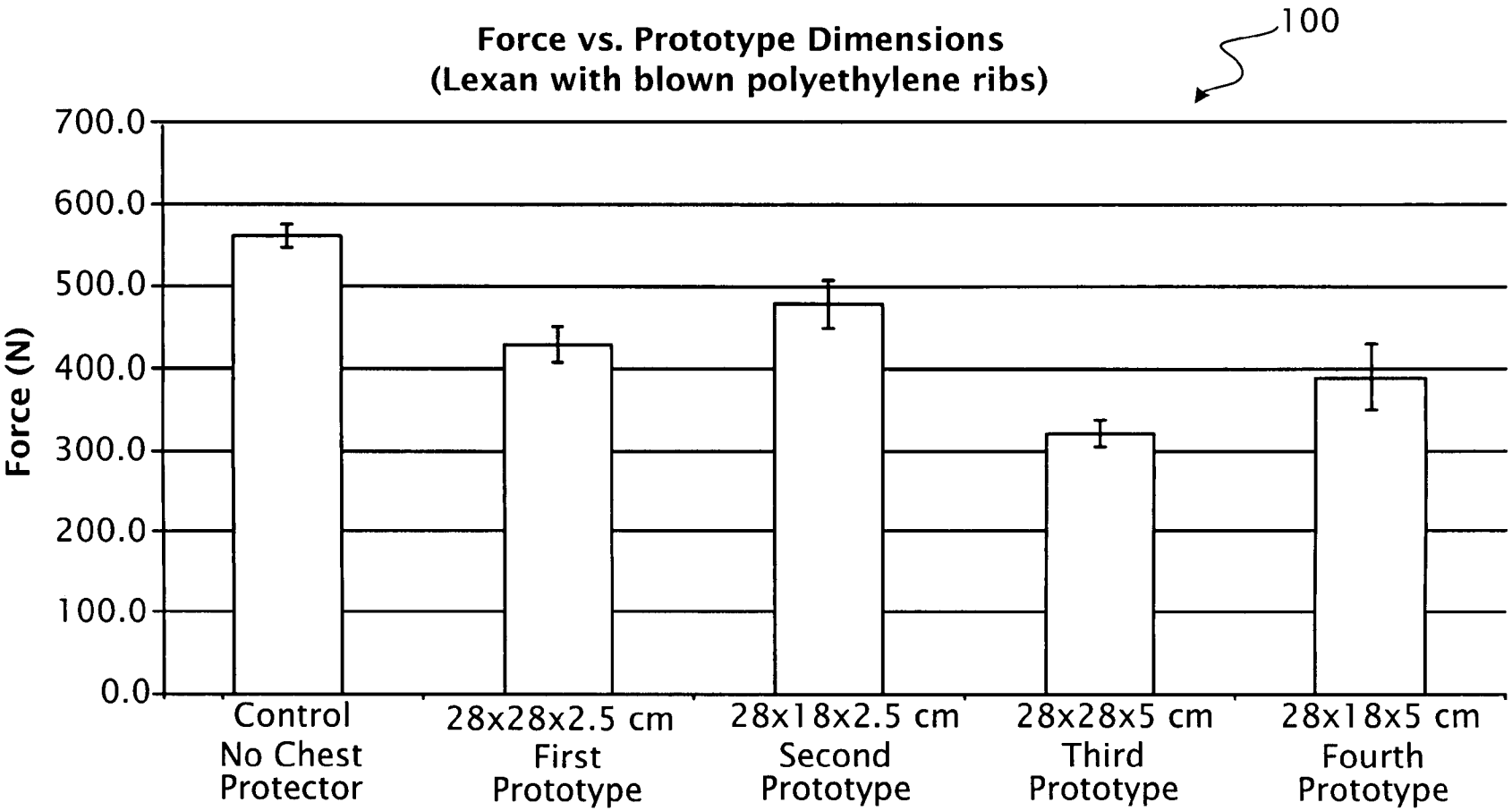
FIGS. 7-9 show graphs.

FIG. 7 is a graph 100 that shows the test results of four prototype chest protectors 10 having two different sizes (H and W of FIG. 5B) of the protector plate 42 and two different depths (T4 of FIG. 5D) of blown polyethylene support ribs 44. The first prototype used a 28 cm×28 cm protector plate 42 and 2.5 cm deep support ribs 44. The second prototype used a 28 cm×18 cm protector plate 42 and 2.5 cm deep support ribs 44. The third prototype used a 28 cm×28 cm protector plate 42 and 5 cm deep support ribs 44. The fourth prototype used a 28 cm×18 cm protector plate 42, and 5 cm deep support ribs 44. The support ribs 44 were 5 cm wide (T6 of FIG. 5D) for all prototypes.

The graph 100 shows that, without any chest protector, the force received by the Vernier plate was a little over 550 N (Newton). The impact force measured for the first, second, third, and fourth chest protectors 10 were about 430 N, 480 N, 320 N, and 390 N, respectively. This shows that all of the chest protectors 10 reduced the impact force by a certain amount. Among the four prototypes, the chest protector 10 using a protector plate 42 having a size of 28 cm×28, and blown polyethylene support ribs 44 having depths of 5 cm, reduced the impart force by the greatest amount.

To determine whether the chest protectors protect the central chest area, carbon paper was attached to the force plate during the experiments. At places where the chest protector 10 pressed against the Vernier force plate, impressions will be made on the carbon paper. The experiments show that, for the chest protectors 10 using support ribs 44 each having a depth of 5 cm, only the support ribs 44 contacted the force plate, and that the Lexan protector plate 42 did not contact the force plate. This indicates that, when a user wears this type of chest protector 10, no (or little) force is transmitted to the central chest, and that the impact force is diverted to side portions of the chest through the blown polyethylene ribs 44.

Figure 8:
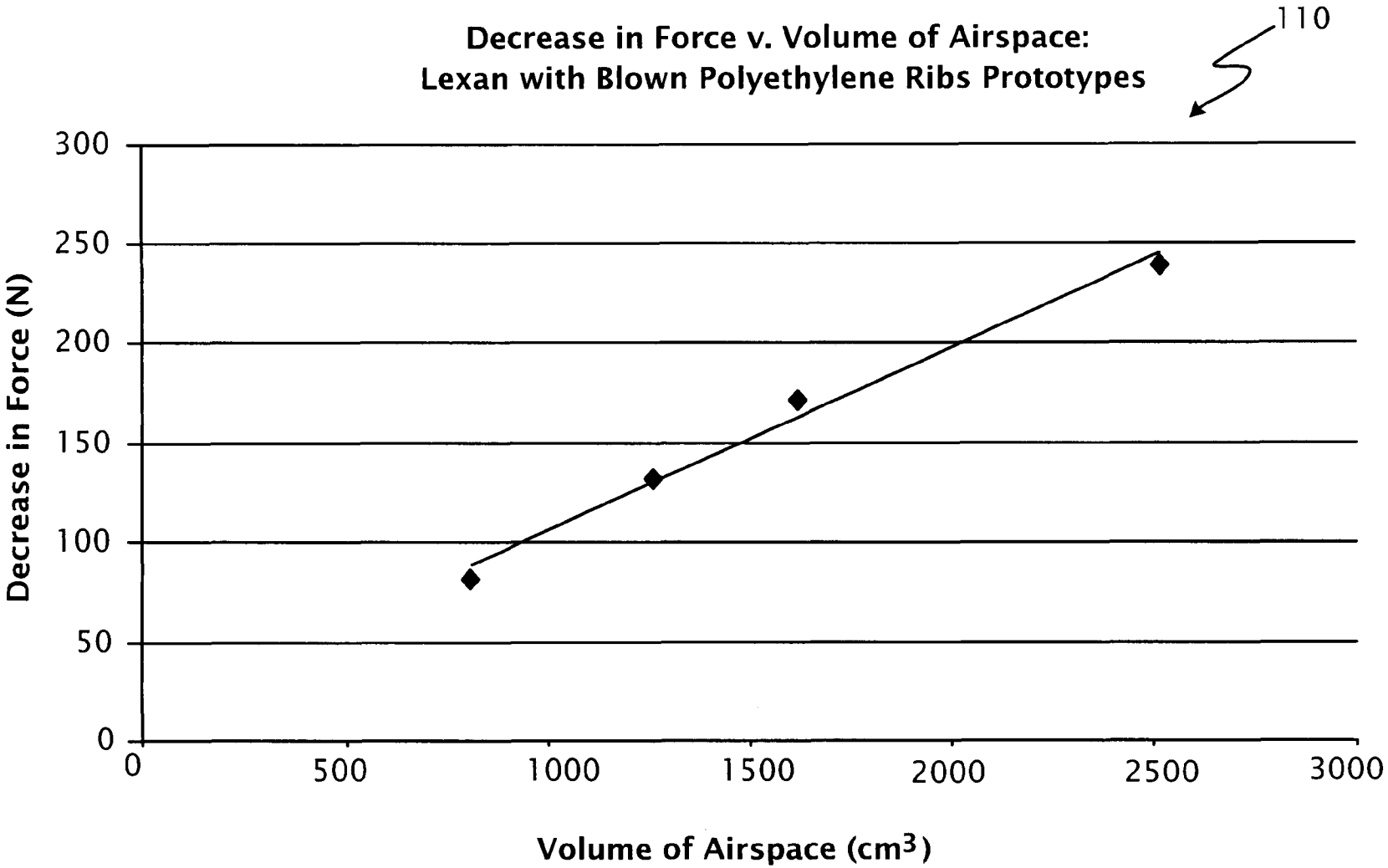

FIG. 8 is a graph 110 that shows a relationship between air volume in the chest protector and the decrease in impact force for the four prototypes described above. The air volume is roughly equal to L1×T4 (see FIG. 5D), where L1 is the distance between the support ribs 44, and T4 is the thickness or depth of the support ribs 44. The graph 110 shows that as the air volume increases, the amount of reduction in the impact force increases. The chest protector 40 using a 28 cm×28 cm protector plate 42 and 5 cm deep support ribs 44 has the largest air volume and the greatest reduction in impact force.

Figure 9:
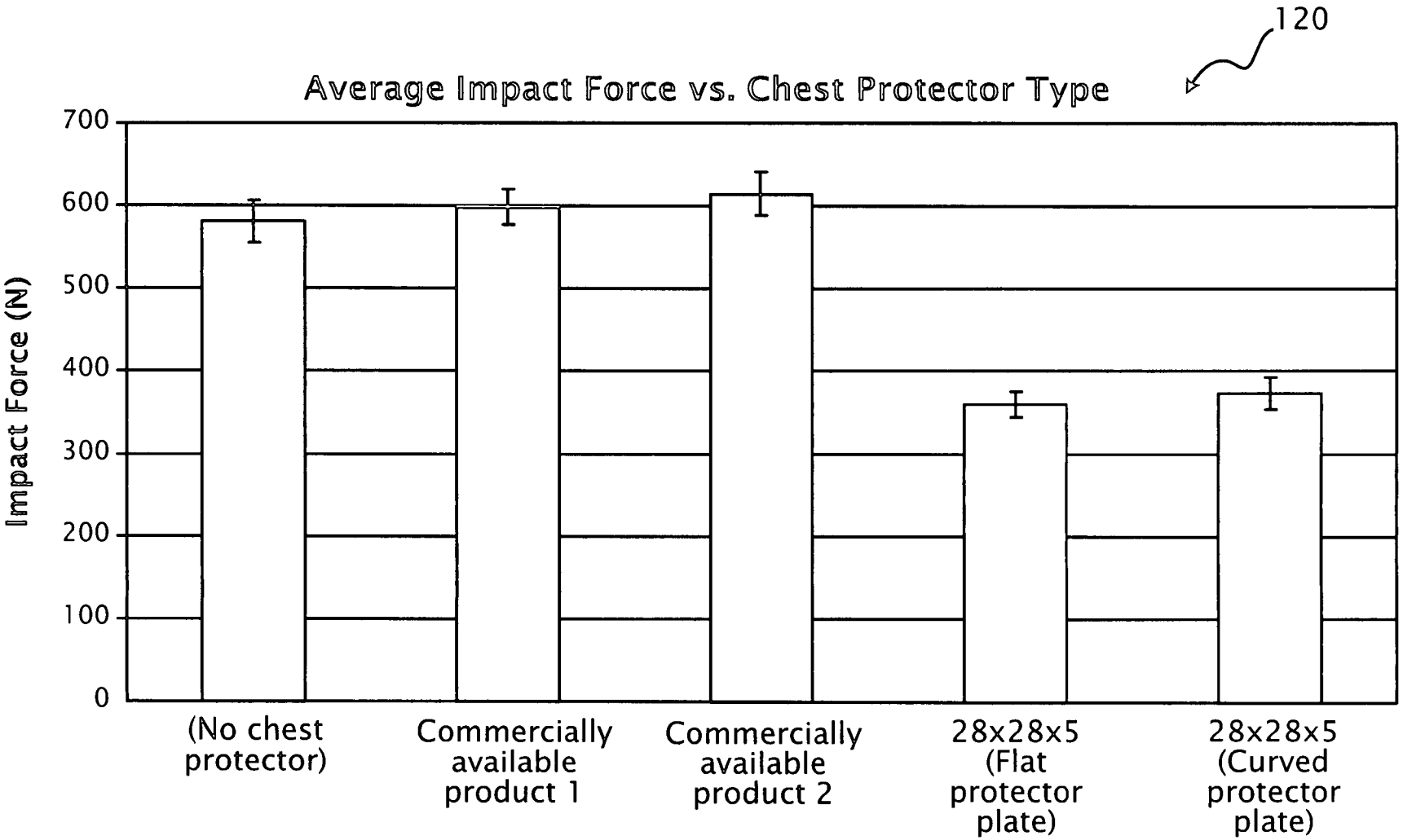

FIG. 9 is a graph 120 that shows a comparison of a first chest protector 10 using the protector module 40, a second chest protector 10 using the protector module 8, and two commercially available chest protectors. The protector module 40 has a flat protector plate 42 that is 28 cm wide and 28 cm high (W=28 cm and H=28 cm in FIG. 5B), and support ribs 44 that are 5 cm deep. The protector module 8 has a curved protector plate that is 28 cm wide and 28 cm high (W=28 cm and H=28 cm in FIG. 3B), and support ribs that are 5 cm deep on the side facing the space 36 (T3=5 cm in FIG. 3D). Both commercially available chest protectors evenly distribute the impact force and do not particularly protect the central chest. The graph 120 shows that the chest protector 10 using the protector module 40 and the chest protector 10 using the protector module 8 are better than the commercially available chest protectors for decreasing the impact force to the chest.

Although some examples have been discussed above, other implementations and applications are also within the scope of the following claims. For example, protector plate, the support ribs, the outer shell, and the elastic straps can be made of materials different than those described above. The size and/or density of the blown polyethylene ribs, and size and/or stiffness of the chest protector can be different from those described above. The shape or curvature of the protector plate can be different. In some examples, the depth of the protector plate 8 in FIG. 4 can be 6.8 cm (i.e., if the protector plate 8 is placed on a flat surface with the side portions 34 contacting the flat surface, the highest point on the curved portion of the protector plate 8 is 6.8 cm above the flat surface). The outer shell can be held in front of the user's chest using means other than elastic straps. Cooperating hook-and-loop-type fasteners can be replaced by other fastening means, such as buttons. The opening of the outer shell and means for closing the opening can be different from those described above.

What is claimed is:

1. A chest protector for reducing risk of commotio cordis, the chest protector comprising:

an inner protector member comprising a protector plate having a first surface facing the user's chest and a second surface facing away from the user's chest, the first surface having a central portion and side portions, the protector plate having a convex surface relative to the chest and maintaining the convex surface when not being worn by the user, the protector plate being a single piece of material that extends from a left side portion of the user's chest to a right side portion of the user's chest; and a pair of spaced apart supporting members attached to side portions substantially near edges of the first surface of the protector plate away from the central portion of the first surface such that an air space is defined by the central portion of the first surface and the pair of spaced apart supporting members, the air space extending at least one-third of the first surface of the protector plate; and an outer shell to enclose the inner protector member;

wherein the protector plate and the pair of supporting members are configured such that the central portion of the first surface of the protector plate is spaced apart from the chest, and when an object impacts the second surface of the protector plate, the impact force is distributed to the supporting members and passed to side portions of the user's chest.

2. The chest protector of claim 1, further comprising straps for holding the outer shell at a location such that the protector plate is positioned in front of the user's chest.

3. The chest protector of claim 2 in which the straps and outer shell are configured to position the pair of spaced apart supporting members away from an area of the chest superficial to the left ventricle of the heart.

4. The chest protector of claim 1 in which the protector plate and the pair of spaced apart supporting members have dimensions and materials such that, when an object having a mass of about 155 grams traveling at about 40 mph impacts the second surface of the protector plate, the impact force passed to the side portions of the user's chest is less than about 70% of the impact force imparted by the object to the second surface of the protector plate.

5. The chest protector of claim 1 in which the protector plate and the pair of spaced apart supporting members have dimensions and materials such that, when an object having a mass of about 155 grams traveling at about 40 mph impacts second surface of the protector plate, the central portion of the protector plate presses against the user's chest at a force that is less than the force that would have imparted to the user's chest if the one or more supporting members were not used.

6. The chest protector of claim 1 in which the protector plate and the pair of spaced apart supporting members have dimensions and materials such that, when an object having a mass of about 155 grams traveling at about 40 mph impacts second surface of the protector plate, the central portion of the protector plate resists pressing against the user's chest.

7. The chest protector of claim 1 in which the protector plate comprises polycarbonate resin.

8. The chest protector of claim 1 in which the pair of spaced apart supporting members comprise shock absorbing material.

9. The chest protector of claim 1 in which the pair of spaced apart supporting members comprise two vertical ribs.

10. The chest protector of claim 1 in which the pair of spaced apart supporting members comprise blown polyethylene.

11. The chest protector of claim 1 in which the protector plate has a width between about 15 cm to about 30 cm.

12. The chest protector of claim 1 in which each of the pair of spaced apart supporting members has a depth between about 2 cm and about 6 cm.

13. The chest protector of claim 1 in which the outer shell comprises a mesh.

14. The chest protector of claim 1 in which the pair of spaced apart supporting members are attached to the left and right side portions of the first surface of the protector plate, the central portion of the first surface extends from a lower edge of the protector plate to an upper edge of the protector plate, and the air space extends from the lower edge of the protector plate to the upper edge of the protector plate.

15. The chest protector of claim 14 in which the air space extends vertically from the lower edge of the protector plate to the upper edge of the protector plate without additional supporting members in the air space.

16. The chest protector of claim 1 in which the protector plate has a thickness of less than 0.1 cm.

17. The chest protector of claim 1 in which the protector plate has a stiffness and strength to sustain an impact from an object having a mass of about 155 grams traveling at about 40 mph, the protector plate upon impact bending towards the chest without contacting the chest and without passing impact force to an area of the chest superficial to the left ventricle of the heart.

18. The chest protector of claim 1 in which the protector plate includes two flat portions at the sides, the flat portions extending substantially from a top portion to a bottom portion of the protector plate.

19. The chest protector of claim 18 in which each supporting member is attached to a portion of the convex surface and one of the flat portions at the side of the protector plate.

20. A chest protector for a user's chest, comprising:

a polycarbonate plate having a surface facing the user's chest, the polycarbonate plate having a convex surface relative to the chest and maintaining the convex surface when not being worn by the user, the polycarbonate plate being a single piece of material that extends from a left side portion of the user's chest to a right side portion of the user's chest;

shock absorbing members attached to the surface of the polycarbonate plate, the shock absorbing members spaced apart and positioned substantially near edges of the polycarbonate plate away from a central portion of the surface of the polycarbonate plate, at least a portion of each shock absorbing member being attached inward from one of the edges of the plate;

an outer shell to enclose the polycarbonate plate and the shock absorbing members, in which the central portion of the surface of the polycarbonate plate, the shock absorbing members, and an inner surface of the outer shell defines an air space, the air space extending at least one-third of the surface of the polycarbonate plate; and straps for holding the chest protector in front of the user's chest such that the air space is between the central portion of the surface of the polycarbonate plate and the user's chest.

21. The chest protector of claim 20 in which the shock absorbing members comprise two vertical ribs.

22. The chest protector of claim 20 in which the shock absorbing members comprise blown polyethylene.

23. The chest protector of claim 20 in which the shock absorbing members are attached to left and right sides of the surface of the polycarbonate plate, the central portion of the surface of the polycarbonate plate extends from a lower edge of the polycarbonate plate to an upper edge of the polycarbonate plate, and the air space extends from the lower edge of the protector plate to the upper edge of the protector plate.

24. The chest protector of claim 23 in which the air space extends vertically from the lower edge of the protector plate to the upper edge of the protector plate without additional shock absorbing members in the air space.

25. The chest protector of claim 20 in which the polycarbonate plate has a stiffness and strength to sustain an impact from an object having a mass of about 155 grams traveling at about 40 mph, the polycarbonate plate upon impact bending towards the chest without contacting the chest and without passing impact force to an area of the chest superficial to the left ventricle of the heart.

26. The chest protector of claim 20 in which the polycarbonate plate includes two flat portions at the sides, the flat portions extending substantially from a top portion to a bottom portion of the polycarbonate plate.

27. The chest protector of claim 26 in which each shock absorbing member is attached to a portion of the convex surface and one of the flat portions at the side of the polycarbonate plate.

28. A chest protector for a user's chest, the chest protector comprising:

a protection means to absorb a portion of an impact force and distribute remaining impact force to side portions of the user's chest away from an area of the chest superficial to the left ventricle of the heart, the protection means comprising a protector plate having a convex shape relative to the chest and maintaining the convex shape when not being worn by the user, the protector plate being a single piece of material that extends from a left side portion of the user's chest to a right side portion of the user's chest, and at least a pair of spaced apart supporting members attached substantially near edges of a user-facing surface of the protector plate away from a central portion of the user-facing surface such that an air space is defined by the central portion of the user-facing surface and the pair of spaced apart supporting members, the air space extending at least one-third of the user-facing surface of the protector plate; and a positioning means to position the protection means in front of the user's chest.

29. The chest protector of claim 28 in which the positioning means comprises an outer shell to enclose the protection means and straps for holding the outer shell at a location such that the protector plate is positioned in front of the user's chest.

30. The chest protector of claim 29 in which the straps and outer shell are configured to position the spaced apart supporting members away from an area of the chest superficial to the left ventricle of the heart.

31. The chest protector of claim 28 in which the protector plate and the supporting members have dimensions and materials such that, when an object having a mass of about 155 grams traveling at about 40 mph impacts an outward facing surface of the protector plate, the impact force passed to the side portions of the user's chest is less than about 70% of the impact force imparted by the object to the outward facing surface of the protector plate.

32. The chest protector of claim 28 in which the protector plate and the supporting members have dimensions and materials such that, when an object having a mass of about 155 grams traveling at about 40 mph impacts an outward facing surface of the protector plate, the central portion of the protector plate presses against the user's chest at a force that is less than the force that would have imparted to the user's chest if the supporting members were not used.

33. The chest protector of claim 28 in which the protector plate has a stiffness and strength to sustain an impact from an object having a mass of about 155 grams traveling at about 40 mph, the protector plate upon impact bending towards the chest without contacting the chest and without passing impact force to an area of the chest superficial to the left ventricle of the heart.

34. The chest protector of claim 28 in which the protector plate includes two flat portions at the sides, the flat portions extending substantially from a top portion to a bottom portion of the protector plate.

35. The chest protector of claim 34 in which each supporting member is attached to a portion of the convex surface and one of the flat portions at the side of the protector plate.

36. A method of reducing risk of commotio cordis, comprising:

positioning a protector plate in front of a user's chest, the protector plate having a convex surface relative to the chest and maintaining the convex surface when not being worn by the user, the protector plate being a single piece of material extending from a left side portion of the user's chest to a right side portion of the user's chest;

providing a pair of spaced apart shock absorbing members between edges of the protector plate and side portions of the user's chest, forming an air space between the protector plate and a central portion of the user's chest, the air space extending at least one-third of the protector plate, the shock absorbing members being attached to side portions of the plate substantially near the edges; and distributing an impact force towards side portions of the user's chest and away from an area of the chest superficial to the left ventricle of the heart; the protector plate and the pair of spaced apart shock absorbing members are enclosed in an outer shell.

37. The method of claim 36 in which the providing comprises providing a pair of spaced apart shock absorbing members that are attached to left and right side portions of the surface of the protector plate, forming an air space extending from a lower edge of the protector plate to an upper edge of the protector plate.

38. The chest protector of claim 37 in which the air space extends vertically from the lower edge of the protector plate to the upper edge of the protector plate without additional shock absorbing members in the air space.

39. The chest protector of claim 36 in which the protector plate has a stiffness and strength to sustain an impact from an object having a mass of about 155 grams traveling at about 40 mph, the protector plate upon impact bending towards the chest without contacting the chest and without passing impact force to an area of the chest superficial to the left ventricle of the heart.

40. The chest protector of claim 36 in which the protector plate includes two flat portions at the sides, the flat portions extending substantially from a top portion to a bottom portion of the protector plate.

41. The chest protector of claim 40 in which each shock absorbing member is attached to a portion of the convex surface and one of the flat portions at the side of the protector plate.

* * * * *